US006779596B2

(12) United States Patent
Wanni et al.

(10) Patent No.: US 6,779,596 B2
(45) Date of Patent: Aug. 24, 2004

(54) HEAT EXCHANGER WITH REDUCED FOULING

(75) Inventors: Amar S. Wanni, Falls Church, VA (US); Marciano M. Calanog, Gainesville, VA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 10/209,082

(22) Filed: Jul. 31, 2002

(65) Prior Publication Data

US 2003/0178185 A1 Sep. 25, 2003

Related U.S. Application Data

(60) Provisional application No. 60/366,776, filed on Mar. 22, 2002.

(51) Int. Cl.[7] ..... F28F 9/02; F28D 7/00

(52) U.S. Cl. ..... 165/158; 165/160; 165/174

(58) Field of Search ..... 165/149, 143, 165/145, 158, 159, 160, 172, 175, 173, 162, 174

(56) References Cited

U.S. PATENT DOCUMENTS

| | | | | | |
|---|---|---|---|---|---|
| 1,184,199 | A | * | 5/1916 | Morison | 165/174 |
| 1,777,356 | A | | 10/1930 | Fisher | |
| 1,946,234 | A | | 2/1934 | Price | |
| 1,978,166 | A | * | 10/1934 | Meurk | 165/134.1 |
| 2,610,832 | A | | 9/1952 | Holmes et al. | |
| 2,774,575 | A | | 12/1956 | Walter | |
| 3,326,282 | A | | 6/1967 | Jenssen | |
| 3,603,383 | A | | 9/1971 | Michael et al. | |
| 3,822,741 | A | * | 7/1974 | Lippitsch | 165/83 |
| 3,984,302 | A | * | 10/1976 | Freedman et al. | 204/274 |
| 4,170,263 | A | * | 10/1979 | Laber et al. | 165/158 |
| 4,386,456 | A | | 6/1983 | Volz | |
| 4,421,160 | A | * | 12/1983 | Stafford et al. | 165/76 |
| 4,450,904 | A | | 5/1984 | Volz | |
| 4,643,248 | A | * | 2/1987 | Voith et al. | 165/95 |
| 4,857,144 | A | * | 8/1989 | Casparian | 159/13.2 |
| 4,871,014 | A | * | 10/1989 | Sulzberger | 165/76 |
| 4,941,512 | A | * | 7/1990 | McParland | 138/97 |
| 5,141,049 | A | * | 8/1992 | Larsen et al. | 165/133 |

FOREIGN PATENT DOCUMENTS

| | | |
|---|---|---|
| DE | 890349 | 9/1953 |
| DE | 928716 | 6/1955 |
| DE | 1261136 | 2/1968 |
| FR | 2059139 | 5/1971 |
| FR | 2380700 | 9/1978 |
| GB | 607717 | 9/1948 |
| GB | 620292 | 3/1949 |
| GB | 644651 | 10/1950 |
| GB | 796923 | 6/1958 |
| JP | 58184498 | 10/1983 |
| WO | WO00/65286 | 11/2000 |

OTHER PUBLICATIONS

English translation (uncertified and Applicant cannot attest to its accuracy) of FR 2,059,139.
English translation (uncertified and Applicant cannot attest to its accuracy) of FR 2,380,700.
English Abstract of JP58184498.
Application Ser. No. 10/209,126, filed Jul. 31, 2002.

* cited by examiner

*Primary Examiner*—Henry Bennett
*Assistant Examiner*—Tho V Duong
(74) *Attorney, Agent, or Firm*—Malcolm D. Keen

(57) ABSTRACT

The present invention comprises a novel heat exchanger configuration which preferably uses the axial flow direction for the shell-side fluid and in which dead zones and areas of stagnation are significantly minimized or eliminated and in which inlet region tube erosion is addressed by providing a sacrificial portion of tube length so as to make repair and replacement of the eroded portion of tubes significantly cheaper, easier and with minimal process interruption. Because axial flow is employed with respect to the shell-side fluid according to a preferred embodiment of the present invention, tube vibration problems are generally eliminated.

24 Claims, 2 Drawing Sheets

HEAT EXCHANGER WITH REDUCED FOULING

RELATED APPLICATION

This patent application claims priority to Provisional Application Ser. No. 60/366,776, filed on Mar. 22, 2002.

BACKGROUND

1. Field of the Invention

The present invention relates generally to heat exchangers and more particularly to design aspects of heat exchanger components.

2. Background of the Invention

Although heat exchangers were developed many decades ago, they continue to be extremely useful in many applications requiring heat transfer. While many improvements to the basic design of heat exchangers have been made over the course of the twentieth century, there still exist tradeoffs and design problems associated with the inclusion of heat exchangers within commercial processes.

In particular, one of the most problematic aspects associated with the use of heat exchangers is the tendency toward fouling. Fouling refers to the various deposits and coatings which form on the surfaces of heat exchangers as a result of process fluid flow and heat transfer. There are various types of fouling including corrosion, mineral deposits, polymerization, crystallization, coking, sedimentation and biological. In the case of corrosion, the surfaces of the heat exchanger can become corroded as a result of the interaction between the process fluids and the materials used in the construction of the heat exchanger. The situation is made even worse due to the fact that various fouling types can interact with each other to cause even more fouling. Fouling can and does result in additional resistance with respect to the heat transfer and thus decreased performance with respect to heat transfer. Fouling also causes an increased pressure drop in connection with the fluid flowing on the inside of the exchanger.

One type of heat exchanger which is commonly used in connection with commercial processes is the shell-and-tube exchanger. In this format, the device is designed such that one fluid flows on the inside of the tubes, while the other fluid is forced through the shell and over the outside of the tubes. Typically, baffles are placed to support the tubes and to force the fluid across the tube bundle in a serpentine fashion.

Fouling can be decreased through the use of higher fluid velocities. In fact, one study has shown that a reduction in fouling in excess of 50% can result from a doubling of fluid velocity. It is known that the use of higher fluid velocities can substantially decrease or even eliminate the fouling problem. Unfortunately, sufficiently high fluid velocities needed to substantially decrease fouling are generally unattainable on the shell side of conventional shell-and-tube heat exchangers because of excessive pressure drops which are created within the system because of the baffles. Also, when shell-side fluid flow is in a direction other than in the axial direction and especially when flow is at high velocity, flow-induced tube vibration can become a substantial problem in that various degrees of tube damage may result from the vibration.

Higher fluid velocities associated with tube-side flow may also be problematic. For example, in the traditional shell-and-tube arrangement, the higher fluid velocities associated with tube-side flow tend to cause erosion of the tube's inner surface particularly at the tube inlet. At a fluid velocity of, for example, 8 feet per second, the inner surface of a brass tube may erode over the length beginning at the inlet and extending for 6 inches or more into the tube. As fluid velocities increase, the problem worsens both in terms of the length of tube subject to erosion and the speed at which erosion occurs.

Tube erosion could eventually undermine the integrity of the tube-to-tubesheet joints. At the extreme, erosion can cause perforation of the tube which ultimately results in mixing between fluids on the shell side and tube side of the exchanger.

Inner surface tube erosion is especially problematic in the shell-and-tube arrangement since once a significant amount of erosion takes place, it becomes necessary to replace or repair the tube. Since, in conventional shell-and-tube heat exchangers, the majority of the tube length subject to erosion is embedded within the interior of the tubesheet, repairs and replacement of the tubes are costly and time consuming. For example, it may be necessary to cut the tube adjacent to the interior surface of both tubesheets, extract the remaining pieces within the interior of the tubesheets, extract the middle portion of the tube (between the two tubesheets), and then clean the surfaces and install a new tube. As is known in the art, this is an arduous process which generally results in significant process downtime.

In addition to the tube erosion problem discussed above, existing shell-and-tube heat exchangers suffer from the fact that "dead zones" and areas of fluid stagnation exist on the shell side of the exchanger. These dead zones and areas of stagnation generally lead to excessive fouling as well as reduced heat-transfer performance. One particular area of fluid stagnation which exists in conventional shell-and-tube heat exchangers is the area near the tubesheet proximate to the outlet nozzle for the shell side fluid to exit the heat exchanger. Because of known fluid dynamic behavior, there tends to exist a dead zone or stagnant region which is located in the region between the each tubesheet and each nozzle. This area of restricted fluid flow on the shell side can cause a significant fouling problem in the area of the tubesheet because of the nonexistent or very low fluid velocities in this region. As is known in the art the same problem as described above also exists within the region adjacent to the inlet nozzle.

SUMMARY OF THE INVENTION

According to a representative embodiment, the present invention comprises a novel heat exchanger configuration which preferably uses the axial flow direction for the shell-side fluid and in which dead zones and areas of stagnation are significantly minimized or eliminated and in which inlet region tube erosion is addressed by providing a sacrificial portion of tube length so as to make repair and replacement of the eroded portion of tubes significantly cheaper, easier and with minimal process interruption. Because axial flow is employed with respect to the shell-side fluid according to a preferred embodiment of the present invention, tube vibration problems are generally eliminated.

In one embodiment of the present invention, a novel heat exchanger is provided such that each of the plurality of tubes contained within the heat exchanger extends a predetermined distance beyond the exterior surface of the tubesheet. The extension of the tubes in this manner permits a length of the tubes located near the inlet portion of the tubes to be employed as a sacrificial section which may be easily replaced prior to the point in time at which inner surface erosion reaches a problematic level. Further, in the event tube erosion does occur in the sacrificial section according to the teachings of the present invention, it is not as significant a cause for concern from the operational standpoint.

In still another embodiment of the present invention, a cone section which connects the shell to the tubesheet assembly is provided in order to allow shell side fluid traveling towards the tubesheet to uniformly and circumferentially exit the tube bundle while minimizing low-flow zones.

In yet another embodiment of the present invention, the novel heat exchanger is formed to include a shell extension which is located such that the shell in the heat exchanger of the present invention extends beyond where the heat exchanger cone meets the shell and further towards the shell-side face of the tubesheet located near the shell side fluid outlet. This shell extension serves to force shell side fluid flow toward the tubesheet in order to further minimize dead zones and regions of low or non-existent fluid flow at or around the center-facing surface of the tubesheet in the region located near the shell side fluid outlet and shell side fluid inlet. The shell extension also limits and/or eliminates shell-side erosion problems because it provides a 360-degree entry and exit path for shell-side fluid flow instead of a configuration where shell-side fluid flows directly against the tube bundle.

In another embodiment, the heat exchanger tubesheet is formed such that a conical extension which is preferably centered at the center of the shell-side face of the tubesheet is present. This conical section serves to further reduce and/or eliminate a small region of stagnation which would otherwise be present in the heat exchanger of the present invention as a result of directional flow caused by the aforementioned cone section and shell extension of the present invention.

In yet another aspect of the present invention, standard size "off-the-shelf" heat exchanger modules are employed to maximize the benefits of the fouling reducing aspects of the present invention and to allow for very significant reductions in design time when preparing to implement processes. According to this aspect of the present invention, several smaller standard size heat exchangers may be employed in parallel or in series or in both parallel and series to achieve the desired process characteristics including meeting the necessary heat-transfer requirements.

As will be recognized by one of skill in the art, and as will be explained in further detail below, the present invention provides many advantages including a significant reduction of dead zones and low-fluid-velocity regions which would otherwise lead to significant fouling problems.

DETAILED DESCRIPTION OF THE PREFERRED EMBODIMENTS

Figure 1:
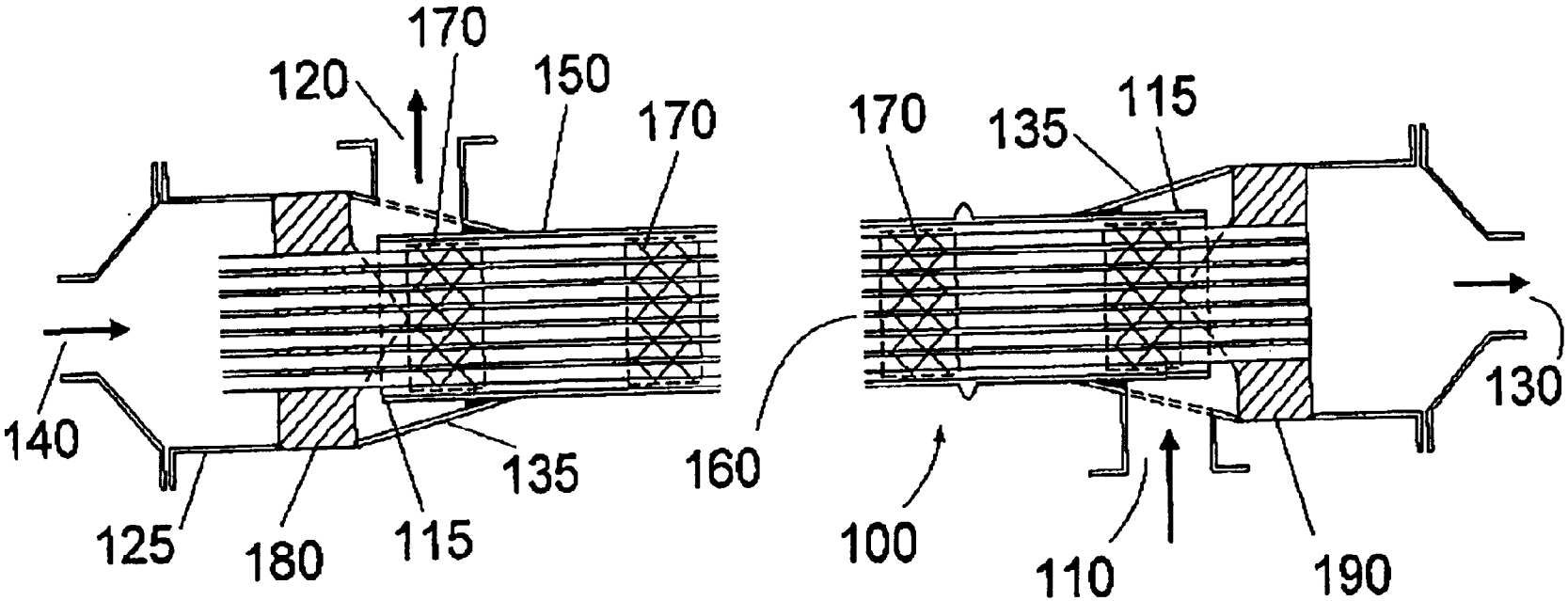
FIG. 1 is a side elevation cutaway view of a single-tube-pass heat exchanger having a non-removable tube bundle and representing a first embodiment of the present invention.

FIG. 1 illustrates a heat exchanger 100 constructed according to the teachings of the present invention. In the figure, the shell portion is broken away to more clearly illustrate the tube bundle construction. While FIG. 1 shows a shell-and-tube exchanger in the form of a single-pass embodiment, the teachings of the present invention are equally applicable to many other forms of shell-and-tube exchangers such as, for example, multi-pass and U-shaped implementations. The heat exchanger 100 of the present invention includes a shell 150 and a tube bundle 160 contained therein.

In a preferred embodiment, tube bundle 160 includes a pair of tubesheets 180 and 190 located, respectively, at each end of the tube bundle 160. The tubes contained in tube bundle 160 are fastened to apertures contained within tubesheets 180 and 190 by means known in the art such as by welding or by expanding the tubes into tubesheets 180 and 190. Tube side inlet 140 and corresponding tube side outlet 130 provide a means for introducing a first fluid into the tubes in tube bundle 160, and for expelling the first fluid from exchanger 100, respectively. Shell side inlet 110 and shell side outlet 120 provide a means for a second fluid to enter and exit the shell side of heat exchanger 100, respectively, and thus pass over the outside of the tubes comprising tube bundle 160.

Preferably, the tubes in tube bundle 160 are supported by the novel coil structure which is disclosed in the assignee's co-pending patent application entitled "Heat Exchanger Flow Through Tube Supports" and which eliminates the need for baffles and allows for high-velocity fluid flow. Alternatively, the tubes in tube bundle 160 may be supported by conventional means such as by "rod baffles", "twisted tubes" or "egg crate" style tube supports. Segmental baffles are not preferable according to the teachings of the present invention because they generally do not allow high-velocity fluid flow and they further create dead zones.

In a preferred embodiment of the present invention, axial flow is used for the shell side fluid. In addition, it is also preferable that a countercurrent flow arrangement be employed as between the two different fluids although a non-countercurrent (i.e. cocurrent) flow may also be implemented according to the teachings of the present invention.

As will be noted in FIG. 1, the tubes in tube bundle 160 extend some length beyond the surface of tubesheet 180 in the direction of and towards tube side inlet 140. In a preferred embodiment of the present invention, the extension is at least 6 inches beyond the surface of tubesheet 180 and possibly more depending upon the intended fluid velocities and the tube metallurgy. The extended tube length employed in connection with the present invention serves as a sacrificial length which may be easily replaced when necessary or desirable so as to avoid the effects of inlet tube erosion which is most prevalent at higher fluid velocities. As will be understood by one of skill in the art, the more rapid the intended fluid velocities, the longer the tube length extension should be. The only practical limitation on the tube length extension is the requirement that the tube length not extend so much such that unfavorable velocity profiles are created within channel 125.

In one embodiment of the present invention, the tube length extension is 6" beyond the surface of tubesheet 180. This length of extension is satisfactory for tube materials such as carbon steel, copper nickel and other metals or other materials which are subject to erosion at levels that can cause perforation problems. In the case of brass or other tube materials which are especially susceptible to erosion, tube lengths are preferably extended beyond 6". Of course, varying extension lengths may be used without departing from the scope or spirit of the present invention. As will be understood by one of skill in the art, the extension length should increase as the tube material's susceptibility to erosion increases.

Although not shown in FIG. 1, the tubes in tube bundle 160 may also be extended in the direction of outlet nozzle 130 and through tubesheet 190. By extending the tubes and providing a sacrificial section that extends beyond both tubesheet 180 and tubesheet 190, a sacrificial section is available if flow direction is reversed and outlet nozzle 130 is employed as an inlet nozzle.

The teachings of the present invention, particularly the use of extended tube lengths, allow for periodic replacement of the sacrificial tube section as erosion occurs or at selected time intervals. The sacrificial section may be cut off and a new sacrificial section may be welded on or otherwise fastened by expanding a new section within the remaining portion of the tube length which extends outward from the tubesheet. Other welding and other techniques may also be employed in order to replace sacrificial tube lengths as may be required.

Yet another aspect of the present invention which serves to eliminate dead zones and low-flow areas and which allows consistent high-velocity fluid flow throughout the heat exchanger 100 of the present invention is also illustrated in FIG. 1. As can be seen in the figure, shell extensions 115 are included so as to extend shell 150 laterally past the point at which the shell 150 meets cone 135 extending from the outer periphery of tubesheets 180 and 190 towards shell 150 and including nozzles 120 and 110, respectively. By extending the shell 150 through the use of shell extensions 115 as indicated in FIG. 1, shell side fluid flow is directed towards the tubesheets 180 and 190 without the fluid having the opportunity to immediately enter or leave the region immediately adjacent to the inlet and outlet nozzles 110 and 170, respectively, where fluid velocity would otherwise be slowed significantly. Further, shell extensions 115 minimize shell-side erosion problems due to the fact that they prevent shell-side fluid from directly flowing against tube bundle 160 upon entry or upon exiting from heat exchanger 100.

Another aspect of the present invention is the inclusion of cone 135 at either or both of the ends of shell 150. Cone 135 preferably extends from the outer surface of shell 150 to tubesheet 180 and/or tubesheet 190. The size and shape of cone 135 is selected based upon fluid modeling studies but in most cases standard parts which are readily available may be selected for use as cone 135. Cone 135, together with shell extension 115, serves to direct fluid flow towards tubesheets 180 and 190 rather than permitting fluid to immediately exit outlet nozzle 170 or to immediately enter the interior of tube bundle 160 from inlet nozzle 110, as applicable. By doing so, the low-velocity fluid zones which would otherwise exist in the vicinity of tubesheets 180 and 190 are eliminated.

FIG. 1 also illustrates the novel conical tubesheet extension of the present invention. As can be seen in the figure, tubesheets 180 and 190 include a conical shaped extension which protrudes toward the interior of the heat exchanger cavity and away from inlet nozzle 140 and outlet nozzle 130 respectively. In one preferred embodiment of the invention, the complete diameter of tubesheets 180 and 190 form the base for the conical protrusion extending from the surface of tubesheets 180 and 190. In another embodiment, only a portion of the diameter of tubesheets 180 and 190 form the base for the conical protrusion. For example, according to this embodiment, the conical protrusion may be formed to have a base diameter of 4"–6" while the diameter of the tubesheets 180 or 190 may be on the order of 12"–24". It is preferable in this embodiment for the center point of the conical protrusion to be the same as the center point of the tubesheets themselves. In other words, the conical protrusion is preferably centered on the circular surface of the tubesheets 180 and 190.

The inclusion of conical protrusions as described above results in the reduction and/or elimination of a small dead zone and low-flow area which would otherwise tend to be present in the present heat exchanger adjacent to the center of the interior tubesheet surface facing the heat exchanger cavity. The particular low-flow area which otherwise would be present in the heat exchanger of the present invention results from the inclusion of the shell extension 115 and cone 135 components of the present invention. By including the tubesheet protrusions in the heat exchanger 100 of the present invention, the spaces in heat exchanger 100 which are taken up by the protrusions which would otherwise be "dead zones" or low-flow areas are filled up with solid material so that the low-flow areas and "dead zones" are eliminated with negligible or no loss of heat-transfer capability.

As will be readily understood by one of skill in the art, the sizing and detailed shape of the conical protrusion may vary from the examples provided above while still remaining within the scope and the spirit of the present invention. Fluid modeling methodologies as are known in the art may be employed if desired to determine the particular sizes and shapes that meet the desired criteria for the specific design. Of course, the conical protrusion on one tubesheet need not be the same in terms of size or shape as another conical protrusion on another tubesheet within a particular heat exchanger. Sizing and shaping between and among protrusions on tubesheet surfaces may vary according to expected specific fluid flow velocities and tendencies.

As can be seen in FIG. 1, the preferable embodiment in which tube supports 170 are included is illustrated. Tube supports 170 are preferably metal coil structures as more fully disclosed in assignee's co-pending patent application entitled "Heat Exchanger Flow Through Tube Supports". By using these novel metal coil structures as tube supports 170, conventional baffles may be eliminated and higher fluid velocities may be employed.

Figure 2:
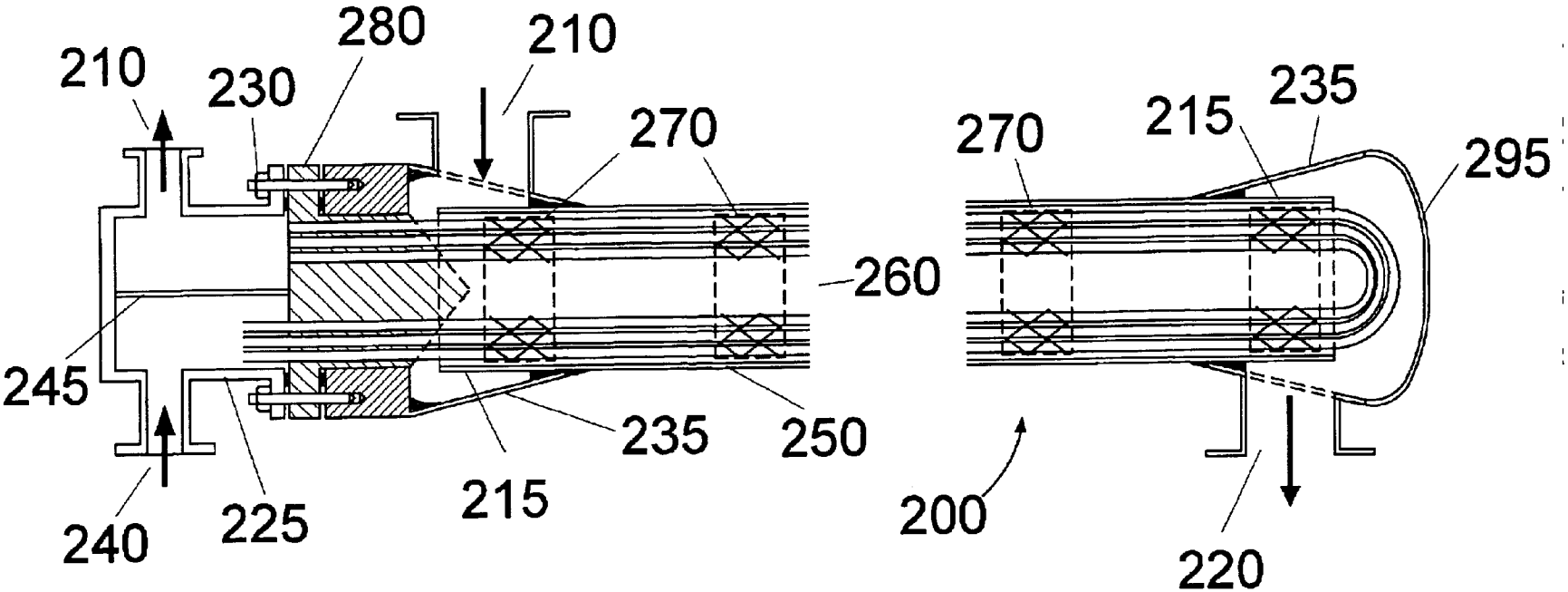
FIG. 2 is a side elevation cutaway view of a two-tube-pass heat exchanger having a removable tube bundle and representing a second embodiment of the present invention.

Turning now to FIG. 2, another embodiment of the present invention is illustrated wherein the novel features discussed above are employed in another heat exchanger configuration. As can be seen in the figure, the heat exchanger 200 illustrated in FIG. 2 is a two-tube-pass configuration with U-shaped tubes. In addition, as opposed to the configuration of heat exchanger 100 in FIG. 1 wherein tubesheet 180, conical section 135 and shell 150, for example, are welded together, the configuration of heat exchanger 200 is such that channel 225, tubesheet 280 and tube bundle 260 are easily removed from the heat exchanger shell body through the use of bolts 230.

In a preferred embodiment, tube bundle 260 includes tubesheet 280 which is located at the end of the tube bundle 260 adjacent to channel 225. Tube side inlet 240 and corresponding tube side outlet 210 provide a means for introducing a first fluid into the tubes in tube bundle 260, and for expelling the first fluid from exchanger 200, respectively. As can be seen in FIG. 2, pass partition plate 245 prevents fluid from entering exchanger 200 through inlet 240 and exiting exchanger 200 through outlet 210 without passing through the tubes in tube bundle 260. Shell side inlet 210 and shell side outlet 220 provide a means for a second fluid to enter and exit the shell side of heat exchanger 200, respectively, and thus pass over the outside of the tubes comprising tube bundle 260.

As is the case with the FIG. 1 embodiment, it is preferable for the tubes in tube bundle 260 to be supported by the novel coil structure which is disclosed in the assignee's co-pending patent application entitled "Heat Exchanger Flow Through Tube Supports" so that baffles may be eliminated and so that high-velocity fluid flow may be achieved. Alternatively, the tubes in tube bundle 260 may be supported by conventional means such as by rod baffles, twisted tubes or egg crate style tube supports. Again, in this embodiment as in the FIG. 1 embodiment, segmental baffles are not preferable according to the teachings of the present invention because they generally do not allow high-velocity fluid flow and they further create dead zones.

Because the FIG. 2 embodiment involves a "U-tube" and thus two tube passes, one of the two passes will be cocurrent with the shell-side flow. Axial flow is preferably used for the shell side fluid in the FIG. 2 embodiment.

As is the case in the FIG. 1 embodiment, the tubes in tube bundle 260 of the FIG. 2 embodiment extend some length beyond the surface of tubesheet 280 in the direction of and towards tube side inlet 240. In the FIG. 2 embodiment of the present invention, the extension is at least 6 inches beyond the surface of tubesheet 280 and possibly more depending upon the intended fluid velocities and the tube metallurgy.

In the FIG. 2 embodiment, the tube length extension may be, for example, 6" beyond the surface of tubesheet 280. Of course, varying extension lengths may be used in the FIG. 2 embodiment without departing from the scope or spirit of the present invention. As will be understood by one of skill in the art, the extension length should increase as the tube material's susceptibility to erosion increases.

Yet another aspect of the present invention which serves to eliminate dead zones and low-flow areas and which allows consistent high-velocity fluid flow throughout heat exchanger 200 of the present invention is also illustrated in FIG. 2. As can be seen in the figure, a first shell extension 215 (on the left side of FIG. 2) extends shell 250 laterally past the point at which the shell 250 meets cone 235 extending from the outer periphery of tubesheet 280 towards shell 250. Cone 235 may also include a flange or ring portion which abuts tubesheet 280 as is shown in FIG. 2. A second shell extension 215 (on the right side of FIG. 2) extends shell 250 laterally past the point at which shell 250 meets cone 235 and towards shell cover 295. Shell cover 295 may be welded to shell 250 as shown in FIG. 2 or it may be attached to shell 250 through the use of bolts or other fastening techniques known in the art. By extending shell 250 through the use of shell extensions 215 as indicated in FIG. 2, shell side fluid flow is directed towards the tubesheet 180 and shell cover 295, respectively, without the fluid having the opportunity to immediately enter the region immediately adjacent to shell-side inlet nozzle 210 and outlet nozzle 220, respectively, where fluid velocity would otherwise be slowed significantly. As in the FIG. 1 embodiment, this arrangement also service to minimize shell-side erosion problems.

Another aspect of the present invention is the inclusion of cones 235 at either or both of the ends of shell 250. Cones 235 preferably extend from the outer surface of shell 250 to tubesheet 280 and/or shell cover 295. The size and shape of cones 235 are selected based upon fluid modeling studies, but in most cases standard parts which are readily available may be selected for use as cones 235. Cones 235 serve to direct fluid flow towards tubesheet 280 and shell cover 295 rather than permitting fluid to flow toward inlet nozzle 210 or outlet nozzle 220 as applicable. By doing so, the low-velocity fluid zones which would otherwise exist in the vicinity of tubesheet 280 and shell cover 295 are eliminated.

FIG. 2 also illustrates the novel conical tubesheet extension of the present invention. As can be seen in the figure, tubesheet 280 includes a conical shaped extension which protrudes toward the interior of the heat exchanger cavity and away from channel 225. In one preferred embodiment of the invention, the complete diameter of tubesheet 280 forms the base for the conical protrusion extending from the surface of tubesheet 280. In another embodiment, only a portion of the diameter of tubesheet 280 forms the base for the conical protrusion. For example, according to this embodiment, the conical protrusion may be formed to have a base diameter of 4"–6" while the diameter of tubesheet 280 may be on the order of 12"–24". It is preferable in this embodiment for the center point of the conical protrusion to be the same as the center point of tubesheet 280 itself. In other words, the conical protrusion is preferably centered on the circular surface of the tubesheet 280.

As will be readily understood by one of skill in the art, the sizing and detailed shape of the conical protrusion for the FIG. 2 embodiment may vary from the examples provided above while still remaining within the scope and the spirit of the present invention.

As can be seen in FIG. 2, the preferable embodiment in which tube supports 270 are included is illustrated. Tube supports 270 are preferably metal coil structures as more fully disclosed in assignee's co-pending patent application entitled "Heat Exchanger Flow Through Tube Supports". By using these novel metal coil structures as tube supports 270, conventional baffles may be eliminated and higher fluid velocities may be employed.

It is preferable that in connection with the use of the heat exchanger of the present invention, a strainer of some form is employed at some point in the process line prior to reaching the heat exchanger. This is important in order to avoid any debris becoming trapped within the heat exchanger of the present invention either in a tube or on the shell side of the heat exchanger. If debris of a large enough size or of a large enough amount were to enter the heat exchanger of the present invention (or, in fact, any currently existing heat exchanger) fluid velocities can be reduced to the point of rendering the heat exchanger ineffective.

The foregoing disclosure of the preferred embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims, and by their equivalents.

What is claimed is:

1. A heat exchanger comprising:

(a) a shell surrounding a tube bundle, said tube bundle comprising a plurality of tubes for transporting a tube-side fluid;

(b) a first inlet for introducing a shell-side fluid into said heat exchanger;

(c) a second inlet for introducing said tube-side fluid into said heat exchanger;

(d) at least two tubesheets, said tubesheets comprising apertures for accepting said tubes; and (e) at least one conical assembly connecting said shell to one of said tubesheets and extending from the outer surface of said shell to said tubesheets (f) at least one of said tubesheets further comprising a conical tubesheet extension which protrudes in the direction toward the interior of said shell.

2. The heat exchanger of claim 1 comprising two conical assemblies wherein said first conical assembly connects said shell to said first tubesheet and said second conical assembly connects said shell to said second tubesheet.

3. The heat exchanger of claim 1 wherein said conical assembly further comprises at least one outlet for permitting said shell-side fluid to exit said heat exchanger.

4. The heat exchanger of claim 1 wherein said conical tubesheet extension is centered on the surface of said tubesheet.

5. A heat exchanger according to claim 1 in which (g) said shell extends in the direction of the tubesheet beyond the point at which said conical assembly contacts said shell.

6. The heat exchanger of claim 5 which includes a second tubesheet and a second conical assembly connecting the second tubesheet to the shell, the shell extending further in the direction of the second tubesheet beyond the point at which said second conical assembly contacts said shell.

7. The heat exchanger of claim 1 wherein each said tube passes completely through said tubesheet and comprises a sacrificial section extending in an axial direction away from said tubesheet and away from said shell.

8. The heat exchanger of claim 5 wherein said heat exchanger is a one-pass heat exchanger.

9. The heat exchanger of claim 1 in which the tubesheet extension is on the tubesheet connected to the conical assembly.

10. The heat exchanger of claim 2 in which each tubesheet comprises a conical tubesheet extension which protrudes in the direction toward the interior of the shell and away from said second inlet nozzle.

11. The heat exchanger of claim 10 in which each tubesheet further comprises a conical tubesheet extension which protrudes in the direction toward the interior of the shell.

12. The heat exchanger of claim 1 in which the exchanger comprises a conical assembly connecting the shell to each tubesheet and each tubesheet comprises a conical tubesheet extension which protrudes in the direction toward the interior of said shell.

13. The heat exchanger of claim 1 in which the tubes of a tube bundle are received in the tubesheet and the diameter of the conical tubesheet extension is the same as the diameter of the tube bundle.

14. The heat exchanger of claim 1 in which the tubes of a tube bundle are received in the tubesheet and the diameter of the conical tubesheet extension is the less than the diameter of the tube bundle.

15. The heat exchanger of claim 2 which one conical assembly further comprises at least one fluid outlet and the other conical assembly further comprises a fluid inlet for admitting shell-side fluid to the heat exchanger.

16. The heat exchanger of claim 10 in which each conical assembly further comprises at least one fluid nozzle.

17. The heat exchanger of claim 16, wherein said heat exchanger is a one-tube-pass heat exchanger.

18. A heat exchanger comprising:

(a) a tube bundle which comprises a plurality of tubes for transporting a tube-side fluid;

(b) a shell surrounding the tube bundle;

(c) a first fluid inlet for introducing a shell-side fluid into the heat exchanger;

(d) a second inlet for introducing the tube-side fluid into said heat exchanger;

(e) a tubesheet having apertures for accepting the tubes of the tube bundle;

(f) a cone connecting the shell to the tubesheet and extending from the outer surface of the shell to the outer periphery of the tubesheet; and (g) a conical tubesheet extension which protrudes from the tubesheet towards the tube bundle in the direction toward the interior of the shell.

19. A heat exchanger according to claim 18 which is a one-pass heat exchanger further comprising a second tubesheet having apertures for accepting the tubes of the tube bundle, a second cone connecting the second tubesheet to the shell, extending from the outer surface of the shell to the outerperiphery of the tubesheet.

20. A heat exchanger according to claim 19 which further comprises a second conical tubesheet extension which protrudes from the second tubesheet towards the tube bundle in the direction toward the interior of the shell.

21. A heat exchanger according to claim 18 in which each tube passes through its aperture of the tubesheet to form a sacrificial section extending from the tubesheet in an axial direction away from the tube bundle.

22. A heat exchanger according to claim 18 in which the tubes of the tube bundle are formed in a "U" shape and the tubesheet has apertures for receiving both ends of each tube.

23. A heat exchanger according to claim 22 in which the shell extends beyond the point at which the cone contacts the shell in the direction towards the tubesheet.

24. A heat exchanger according to claim 21 which includes a partition between the respective ends of the U shaped tubes, to separate the fluid inlet for the tube side fluid from the fluid outlet for the tube side fluid.

* * * * *